United States Patent [19]

Takahashi

[11] 4,234,946

[45] Nov. 18, 1980

[54] ELECTRONIC WRISTWATCHES

[75] Inventor: Kotaro Takahashi, Sayama, Japan

[73] Assignee: Citizen Watch Co., Ltd., Tokyo, Japan

[21] Appl. No.: 970,905

[22] Filed: Dec. 19, 1978

[30] Foreign Application Priority Data

Dec. 22, 1977 [JP] Japan ..... 52/171906[U]

[51] Int. Cl.[3] ..... G04B 19/24; G04B 27/00

[52] U.S. Cl. ..... 368/76; 368/34; 368/185

[58] Field of Search ..... 58/5, 7, 23 BA, 52, 58/64–66, 85.5, 888, 58, 104; 368/76, 34, 185

[56] References Cited

U.S. PATENT DOCUMENTS

| | | | |
|---|---|---|---|
| 3,032,651 | 5/1962 | Gisiger-Stähl et al. | 58/23 BA |
| 3,762,153 | 10/1973 | Komiyama et al. | 58/58 |
| 3,817,024 | 6/1974 | Noguchi | 58/85.5 |

FOREIGN PATENT DOCUMENTS

| | | | |
|---|---|---|---|
| 1517776 | 12/1978 | France | 368/190 |

*Primary Examiner*—Edith S. Jackmon
*Attorney, Agent, or Firm*—Jordan and Hamburg

[57] ABSTRACT

This invention relates to a battery powered electronic wristwatch having a time changing device accommodated in a recess in the base plate of the watch which device operatively is connected to the adjustment shaft manipulatable externally of the watch casing to alter the position of the hands of the watch. The time changing device includes a pivotable setting lever which cooperates with the adjustment shaft and a spring for controlling the movement of the setting lever. A fixed body portion of the spring has a portion of its periphery shaped so as to conform to a peripheral portion of a base recess for accommodating the watch battery.

6 Claims, 2 Drawing Figures

PRIOR ART

ELECTRONIC WRISTWATCHES

TECHNICAL FIELD

The present invention relates to an electronic wristwatch and more particularly to the arrangement and structure of the watch.

BACKGROUND ART

Generally, time changing devices of conventional timepieces are disposed on one surface of a base plate which confronts the dial of the watch or on the opposite surface of the base plate confronting the back cover of the watch. The first mentioned type of arrangement although more popular cannot avoid an increase in the spacing between the externally operable hand adjustment shaft and the dial because the time changing device overlaps a calender member and the like operated by a clutch wheel engaged with a calendar member and the adjustment shaft which should necessarily be positioned to confront the dial. Accordingly, although the watch mechanism can be housed in a thin casing the finished timepiece has its winding crown positioned not in the expected central area of the casing but closer to the back cover of the casing owing to the excessive length of the adjustment shaft. This is detrimental to the appearance or design which is one of vital conditions of a thin timepiece.

FIG. 1 illustrates the second mentioned type of arrangement in which the time changing device is mounted on the opposite side of the base plate i.e. the surface confronting the back cover.

FIG. 1 is a plan view of the mechanism of a conventional electronic timepiece. The time changing device has its position in a horizontal plane restricted by various components of the watch including a battery 1, a driving coil 2, a circuit board 3 carrying IC, quartz vibrator and like circuit components, and a gear train bridge 4. A setting lever 6 is operatively connected with the adjustment shaft 5 and lever 6 has its angular position controlled by a cam portion **7*b* provided at the end of a resilient extension arm 7*a* of a setting lever spring 7. The resilient extension arm 7*a* allows the cam portion 7*b* to flex which occurs when a cam follower comprising a pin 6*a* upstanding from the setting lever 6 passes over the cam surface of portion 7*b*. Another function of the extension arm 7*a* is to provide a 'snap' action for the shaft 5 into and out of the casing of the watch. Preferably, the resilient extension arm 7*a* is formed as long as space permits from the aspect of strength and also as wide as possible from the viewpoint of machinability. A fixed body part 7*c* of the spring 7 is positioned above the battery 1 as viewed in the drawing to ensure a sufficient length of the resilient extension arm 7*a***.

Thus, the arrangement mentioned above is inferior to the first mentioned arrangement as regards horizontal space since the battery 1, quartz vibrator, circuit board 3, gear train, transducer and like components are arranged on that surface of the base plate 10 confronting the back cover. Moreover, the adjustment shaft 5 which is manipulatable for the correction of the hands of the watch and calender has its axially outward position limited by the spring 7 with a snap action. To limit outward movement of shaft 5 the spring 7 includes the cam portion forming a leading end of the resilient arm and the pin **6*a* fixed on the setting lever 6 is movable into and out of the position limiting recesses of the cam portion. To provide the snap action, the pin mentioned above moves over the ridge of the cam portion thereby flexing the resilient arm. Thus, the durability and reliability of the spring 7 must be enhanced by making the resilient arm as long as possible. This brings about another cause of the difficulty which is experienced in disposing the time changing device on the side of the base plate confronted by the back cover. More specifically, the distance between the axis of locating pins 8 and 9 on the spring 7 is so short that the positional accuracy of the cam portion 7*b*** is poor. This is because the horizontal space surrounding the battery has not been used effectively.

DISCLOSURE OF THE INVENTION

The present invention provides an improved component arrangement particularly suitable for producing a small size, thin timepiece by eliminating the difficulty concerned with the horizontal space requirement. In order to achieve this the arrangement according to the present invention includes a setting lever spring which regulates the angular position of the setting lever operatively connected with the adjustment shaft and other externally operated members shaped so as to conform with the shape of a part of the periphery of the battery for improving the space efficiency.

DETAILED DESCRIPTION OF THE INVENTION

Figure 1:
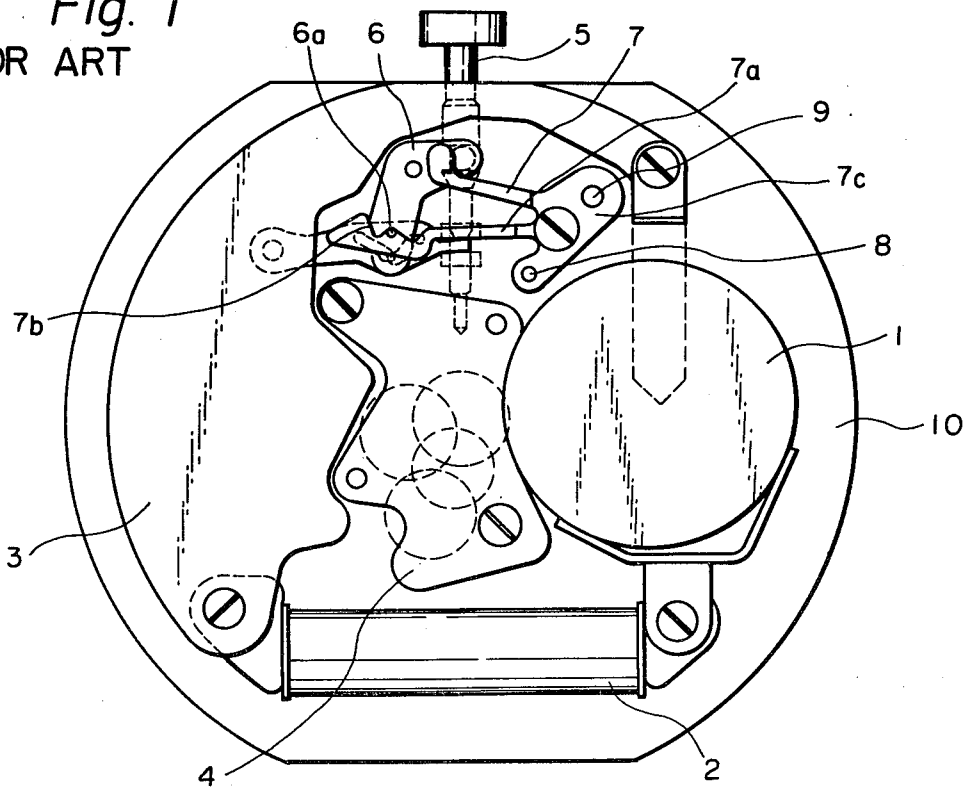
Fig. 1 PRIOR ART
FIG. 1 is a plan view showing the mechanism of a known conventional electronic wristwatch.
Figure 2:
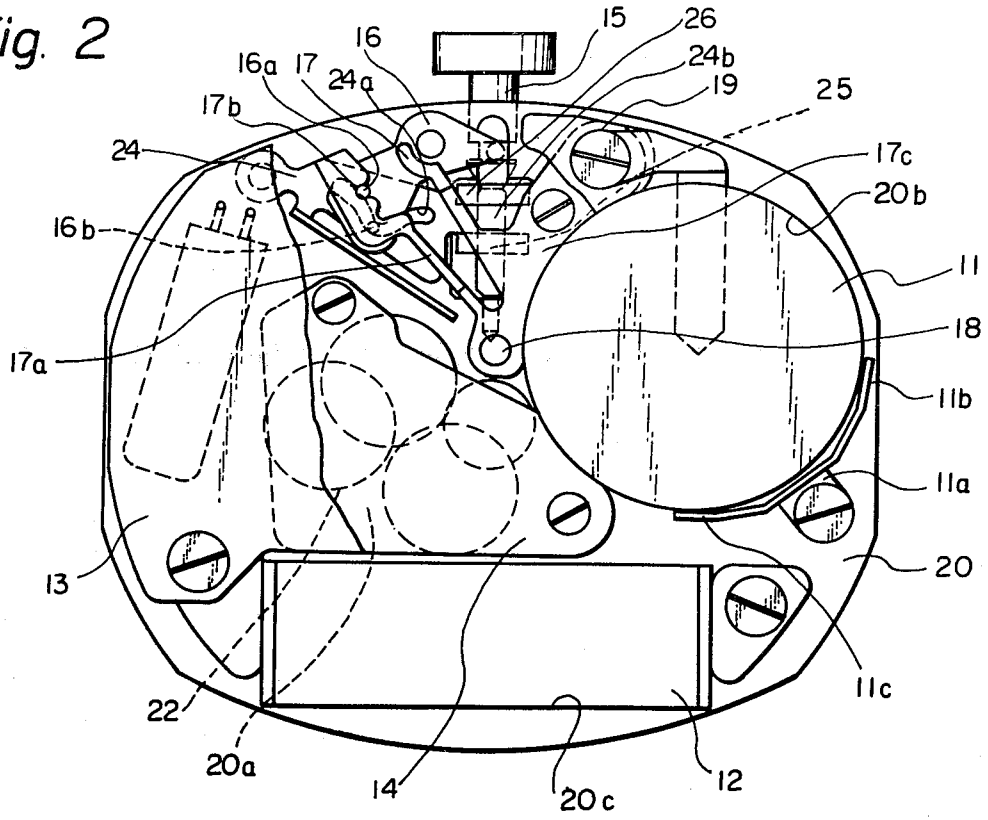
FIG. 2 is a plan view showing the mechanism of an electronic wristwatch in accordance with the invention.

Referring now to FIG. 2, there is shown a movement construction for an electronic wristwatch according to the present invention. The movement construction comprises a base plate 20 which has a first recess **20*a* in one surface thereof to accomodate a gear train mechanism 22, a second recess 20*b* formed in the surface of the base plate 20 to accommodate a battery 11, and a third recess 20*c* formed in the surface of the base plate 20 to accommodate a driving coil 12. The second recess 20*b* is formed in the base plate 20 such that a major portion of the battery 11 assumes a position substantially at a region near a time adjustment shaft or winding stem 15 movable in a radial base 25 of the base plate and defined by a line passing through 6—12 hour points of a time dial (not shown). Move specifically, the second recess 20*b* is formed at a position such that the major portion of the battery 11 assumes a position at a region defined by lines passing through 12—3 hour points of the time dial. The third recess 20*c* is formed in the base plate 20 at a region defined by a line passing through 6—12 hour points of the time dial and remote from the adjustment shaft 15**.

A magnetic shield member (not shown) is disposed adjacent the battery 11 and a spring portion **11*b* of a battery retaining spring 11*a* adapted to resiliently engage with the battery. The time changing device assumes a position in a horizontal plane which is limited by the driving coil 12, a circuit board 13 carrying various circuit components thereon, a gear train bridge 14 and other. A setting lever spring 17 has a resilient arm 17*a* formed with a cam portion 17*b* at its extreme end. The cam portion 17*b* serves to regulate the angular position of a setting lever 16 which is interlocked with externally operated members such as the adjustment shaft 15. When a pin 16***a* carried by the setting lever 16 moves over the cam surface of the cam portion 17*b*, the resilient arm 17*a* allows the cam slide portion 17*b* to flex. Concurrently, the shaft 15 performs a snap action with the aid of the resilient arm 17*a*. It is desirable that arm 17*a* has a maximum possible length for reasons of mechanical strength and as large a width as possible for ease of machinability during manufacture.

Thus, to ensure a sufficient length of the resilient arm 17*a*, a fixed body portion 17*a* contiguous with the resilient arm has a portion of its periphery shaped arcuately as viewed in the drawing to conform with a portion of the periphery of the battery 11 when accommodated in its recess 20*b* in the base plate. The setting lever 16 has a downwardly extending pin 16*b* in engagement with a cam recess 24*a* of a clutch lever 24. The clutch lever 24 has a projection 24*b* in engagement with toothed wheels 26 which are axially movable by the action of the projection 24*b* into or out of engagement with a setting weel (not shown) of the gear train mechanism 22 when the adjustment shaft 15 is axially moved to predetermined locations.

It will be appreciated from the foregoing that the mechanical strength and durability of a setting lever spring is increased by the considerable length of its resilient arm. Also, the fixed body portion 17*a* of the spring and therefore the distance between the axes of pins 18 and 19 for positioning the setting lever spring can be made long enough to enhance the positional precision of the cam portion 17*b*. Since the setting lever spring partly embraces the battery 11 over about ¼ of the entire periphery of the latter and therefore also functions as a stopper, a circuit board 13 carrying circuit components which are particularly susceptible to impacts possibly caused by the battery when the watch is dropped can extend as far as the vicinity of the battery. This not only creates an additional space for the circuit board but provides a guide for locating the battery during installation.

I claim:

1. In a watch movement construction for an electronic wristwatch powered by a battery and having time indicating hands, the improvement comprising:

a base plate having a radial bore, and a recess formed on one side of said base plate to accommodate said battery;

a time adjustment shaft movable in said radial bore of said base plate to predetermined locations for correcting said time indicating hands;

a setting lever pivotally mounted on said one side of said base plate and cooperating with said time adjustment shaft; and a spring mounted on said one side of said base plate, said spring comprising a resilient arm for urging the setting lever in a given direction and a fixed body part having a peripheral edge portion conforming to a portion of the periphery of said recess.

2. The improvement as set forth in claim 1, further comprising a battery retaining spring fixed to said one side of the base plate for urging the battery towards the fixed body part of the spring to retain the battery in said recess.

3. The improvement as set forth in claim 2, in which the battery retaining spring has at least two components each for engaging separate portions of the periphery of the battery.

4. The improvement as set forth in claim 1, further comprising a circuit substrate mounted on said one side of the base plate remote from said recess.

5. The improvement as set forth in claim 1, in which said recess is formed in said base plate such that a major portion of the battery assumes a position substantially at a region near said time adjustment shaft and defined by a line passing through 6—12 hour points of a time dial.

6. The improvement as set forth in claim 1, in which said watch has a driving coil, and in which said base plate has another recess formed in said one side of the base plate at a region defined by a line passing through 6—12 hour points of a time dial and remote from said time adjustment shaft.

* * * * *